US006582122B2

(12) United States Patent
Shimizu

(10) Patent No.: US 6,582,122 B2
(45) Date of Patent: Jun. 24, 2003

(54) CHUCK AND PLASTIC PACKAGING BAG WITH CHUCK

(75) Inventor: Nobutoshi Shimizu, Aichi-Ken (JP)

(73) Assignee: Kabushiki Kaisha Aichi Shokai (JP)

( * ) Notice: Subject to any disclaimer, the term of this patent is extended or adjusted under 35 U.S.C. 154(b) by 0 days.

(21) Appl. No.: 09/997,929

(22) Filed: Nov. 30, 2001

(65) Prior Publication Data

US 2002/0114540 A1 Aug. 22, 2002

(51) Int. Cl.[7] ..... B65D 33/16
(52) U.S. Cl. ..... 383/63; 24/585.12
(58) Field of Search ..... 383/63; 24/585.12, 24/DIG. 50

(56) References Cited

U.S. PATENT DOCUMENTS 3,372,442 A * 3/1968 Ishimatsu ..... 24/585.12
3,425,469 A * 2/1969 Ausnit ..... 24/585.12
4,787,755 A * 11/1988 Branson ..... 156/66
4,819,309 A * 4/1989 Behymer ..... 24/586.11
5,689,866 A * 11/1997 Kasai et al. ..... 24/400
5,718,024 A * 2/1998 Robbins ..... 24/30.5 R
5,988,880 A * 11/1999 Tomic ..... 24/400
6,004,032 A * 12/1999 Kapperman et al. ..... 24/585.12
6,009,603 A * 1/2000 Gallagher ..... 24/399
6,152,600 A * 11/2000 Tomic ..... 24/585.12
6,217,215 B1 * 4/2001 Tomic ..... 24/DIG. 50

* cited by examiner

*Primary Examiner*—Jes F. Pascua
(74) *Attorney, Agent, or Firm*—Ostrolenk, Faber, Gerb & Soffen, LLP

(57) ABSTRACT

A chuck for a plastic packaging bag, comprises: a male member having a male claw portion; a female member having a female claw portion; and a mechanism for causing the male claw portion to engage and disengage from the female claw portion, wherein one of the male claw portion and the female claw portion has one or more linear protrusions which extend in longitudinal directions in a contact portion in which the male claw portion engages the female claw portion, and wherein the male claw portion contacts the female claw portion in the contact portion by a line contact, by which the one or more linear protrusions of the one of the male claw contact the other claw portion of the male claw portion and the female claw portion and by a surface contact, by which that the male claw portion contacts the female claw portion.

9 Claims, 12 Drawing Sheets

CHUCK AND PLASTIC PACKAGING BAG WITH CHUCK

BACKGROUND OF THE INVENTION

1. Field of the Invention

The present invention generally relates to a chuck which is to be attached to a plastic packaging bag, and a plastic packaging bag with a chuck, which utilizes the same.

2. Description of the Prior Art

Plastic chucks are easy to be repeatedly open and closed. For that reason, plastic chucks are attached to practical plastic packaging bags (which will be also hereinafter referred to as "packaging bags") for many uses. Such a chuck has an opening/closing mechanism based on a zipper or bite. Most of chucks have an opening/closing mechanism based on a bite.

FIG. 7 is an illustration showing a conventional packaging bag with a chuck. This packaging bag 70 is provided with a chuck 71 which runs the length (shown by L in FIG. 7) of the inside face of an opening of the packaging bag 70.

FIG. 8 is a perspective view of a bite-type chuck which is provided on the packaging bag 70. The chuck 80 is designed to open and close the packaging bag 70 by the engagement and release of the male claw portion 81*a* of a male member 81 with and from the female claw portions 82*a*, 82*a* of a female member 82. The chuck 80 is fixed to the packaging bag 70 by fixing the base portions 81*c* and 82*c* of the male member 81 and female member 82 to the base material film of the packaging bag 70 by the heat seating (heat fusion).

Although the mechanism of the chuck 80 for closing the packaging bag 70 by means of the male and female claw portions 81*a*, 82*a* and 82*a* may be expressed by the term "biting mechanism", "fitting mechanism", "engaging mechanism", "locking mechanism" or the like, these terms may be used to be technically synonymous with each other. Throughout the specification, the term "bite" will be used hereinafter. Although the chucks 71 and 80 may be expressed by the term "biting device", "fitting device", "engaging device" or the like, these terms may be used to be technically synonymous with each other. Throughout the specification, the term "chuck" will be used hereinafter.

FIG. 9 is a cross-sectional view of another chuck which has been conventionally proposed. In this chuck, the male claw portion 90*a* of a male member 90 is designed to partially contact and engage the female portions 91*a*, 91*a* of a female member 91.

FIG. 10 is a cross-sectional view of a further chuck which has been conventionally proposed (see Japanese Patent Laid-Open No. 9-37816, etc.). In this chuck, the rounded male claw portion 100*a* of a male member 100 and the female claw portion 101*a* of a female member 101 are designed to have a bite. The chuck shown in FIG. 10 relates to a proposal wherein intermediate layers 102 and 103 are provided between polyester packing bag base material films which are generally difficult to be head-sealed.

FIG. 11 is also a cross-sectional view of a still further chuck which has been conventionally proposed. In this chuck, the outside projecting portions of the double male claw portions 110*a*, 110*a* of a male member 110, which vertically project from the surface of the male member 110 and which extend in parallel to each other, are designed to contact and engage the female claw portions 111*a*, 111*a* of a female member 111.

In most of conventional general chucks, part of male and female claw portions are designed to contact and engage each other so as to have inferior sealing performance in order to ensure a practical smooth opening/closing operation (e.g., see FIGS. 8, 9 and 11). In addition, since the male and female members of the chucks are molded by the profile extrusion molding method, the chucks can be formed by the profile extrusion molding method, and the male and female members are formed of a thermoplastic which is easily heat-sealed (see Japanese Patent Laid-Open No. 9-37816, etc.).

On the other hand, there is a tendency for packaging bags, such as refrigerating preserving bags and electronic oven heating bags, to be generally formed of a base material film having heat resistance, cold resistance and other characteristics (e.g., a polyamide (e.g., nylon 12) or a polycapramide (e.g., nylon 6)), so that it is difficult to fix conventional chucks to such packaging bag base material films by the heat sealing.

For that reason, the development of chucks has been generally directed to the improvement of base material films, which are difficult to be heat-sealed, and fixing means (see Japanese Patent Laid-Open Nos. 9-37816, 9-156646, 9-94931, 9-216642, etc.), so that chucks have been generally attached to packaging bags for goods which do not require sealing performance. In the circumstances, a chuck capable of blocking liquid has been studied and proposed (see Japanese Patent No. 293878).

FIG. 12 is a cross-sectional view of a chuck having high liquid blocking performance (see Japanese Patent No. 293878, page 5, FIG. 1). In this chuck, the double male claw portions 120*a*, 120*a* of a male member 120, which vertically project from the surface of the male member 120 and which extend in parallel to each other, are designed to be pushed by a pressing rib 120*b* to strongly contact and engage the female claw portions 121*a*, 121*a* of a female member 121. In the experiment wherein a packaging bag with the chuck shown in FIG. 12 is filled with water to be dropped from a height of 30 cm, water does not leak out (see Japanese Patent No. 293878, page 4, Example and Table 1). However, in the chuck shown in FIG. 12, the male claw portions 120*a*, 120*a* are deformed as a whole during bite, so that there is some possibility that distortion may occur in the male claw portions 120*a*, 120*a* by repeatedly opening and closing the chuck. Conventionally, even in the chuck realizing liquid blocking performance shown in FIG. 12 (see Japanese Patent No. 293878), any contact mechanism in a contact portion in which the male claw portions contact the female claw portions has not been studied, and it is only suggested that a line contact or a surface contact can obtain target sealing performance (see Japanese Patent No. 293878, page 2).

With the advance of technology, packaging bags of a base material film having high gas impermeability (e.g., a film having gas impermeability which is increased by selecting the kind of a raw material and laminating) come into wide use, and are used for various goods (e.g., foods, medicines and so forth which deteriorate in the presence of oxygen) which essentially require gas impermeability (generally air impermeability).

However, it has been considered that the sealing performance of the chuck is limited to the blocking of liquid, and there has been no idea that gas blocking performance is given to the chuck, so that the gas blocking performance of the chuck has not been studied and proposed. In addition, the details of the contact mechanism of the male and female claw portions during the bite of the chuck have not been studied.

Therefore, the inventor studied the details of the contact mechanism of male and female claw portions during the bite of a chuck, and found that a chuck having sealing performance, such as gas blocking performance, can not be obtained unless both of line and surface contacts exist.

SUMMARY OF THE INVENTION

It is therefore a principal object of the present invention to eliminate the aforementioned problems and to provide a chuck which has sealing performance, such as gas blocking performance capable of blocking various gases, and which is capable of being smoothly open and closed, the sealing performance of the chuck being held after the chuck is repeatedly open and closed, and the chuck being capable of being easily produced and easily fixed to a base material film of a packaging bag by the head sealing.

It is another object of the present invention to provide a chuck capable of causing a packaging bag to serve as an airtight container.

It is a further object of the present invention to provide a plastic packaging bag with a chuck, which has a housing region (typically, an airtight housing region) isolated from external environment and which is capable of being easily open and closed.

In order to accomplish the aforementioned and other objects, according to one aspect of the present invention, there is provided a chuck for a plastic packaging bag, the chuck comprising: a male member having a male claw portion; a female member having a female claw portion; and a mechanism for causing the male claw portion to engage and disengage from the female claw portion, wherein one of the male claw portion and the female claw portion has one or more linear protrusions which extend in longitudinal directions in a contact portion in which the male claw portion engages the female claw portion, and wherein the male claw portion contacts the female claw portion in the contact portion by a line contact, by which the one or more linear protrusions of the one of the male claw contact the other claw portion of the male claw portion and the female claw portion and by a surface contact, by which that the male claw portion contacts the female claw portion.

According to another aspect of the present invention, there is provided a plastic packaging bag with a chuck which comprises a male member having a male claw portion, a female member having a female claw portion, and a mechanism for causing the male claw portion to engage and disengage from the female claw portion, wherein one of the male claw portion and the female claw portion has one or more linear protrusions which extend in longitudinal directions in a contact portion in which the male claw portion engages the female claw portion, and wherein the male claw portion contacts the female claw portion in the contact portion by a line contact, by which the one or more linear protrusions of the one of the male claw contact the other claw portion of the male claw portion and the female claw portion and by a surface contact, by which that the male claw portion contacts the female claw portion, the plastic packaging bag being formed of a gas impermeable plastic film as a base material film.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, particularly to FIGS. 1 through 6, the preferred embodiments of a chuck according to the present invention will be described below. Furthermore, the embodiments shown in FIGS. 1 through 6 are preferred embodiments of the present invention, and are part of various examples included in the present invention. In the following figures, the same reference numbers are given to the same or similar elements.

A chuck according to the present invention has a structure that male and female claw portions contact and engage each other in contact portions, in which both of line and surface contacts exist.

Figure 1:
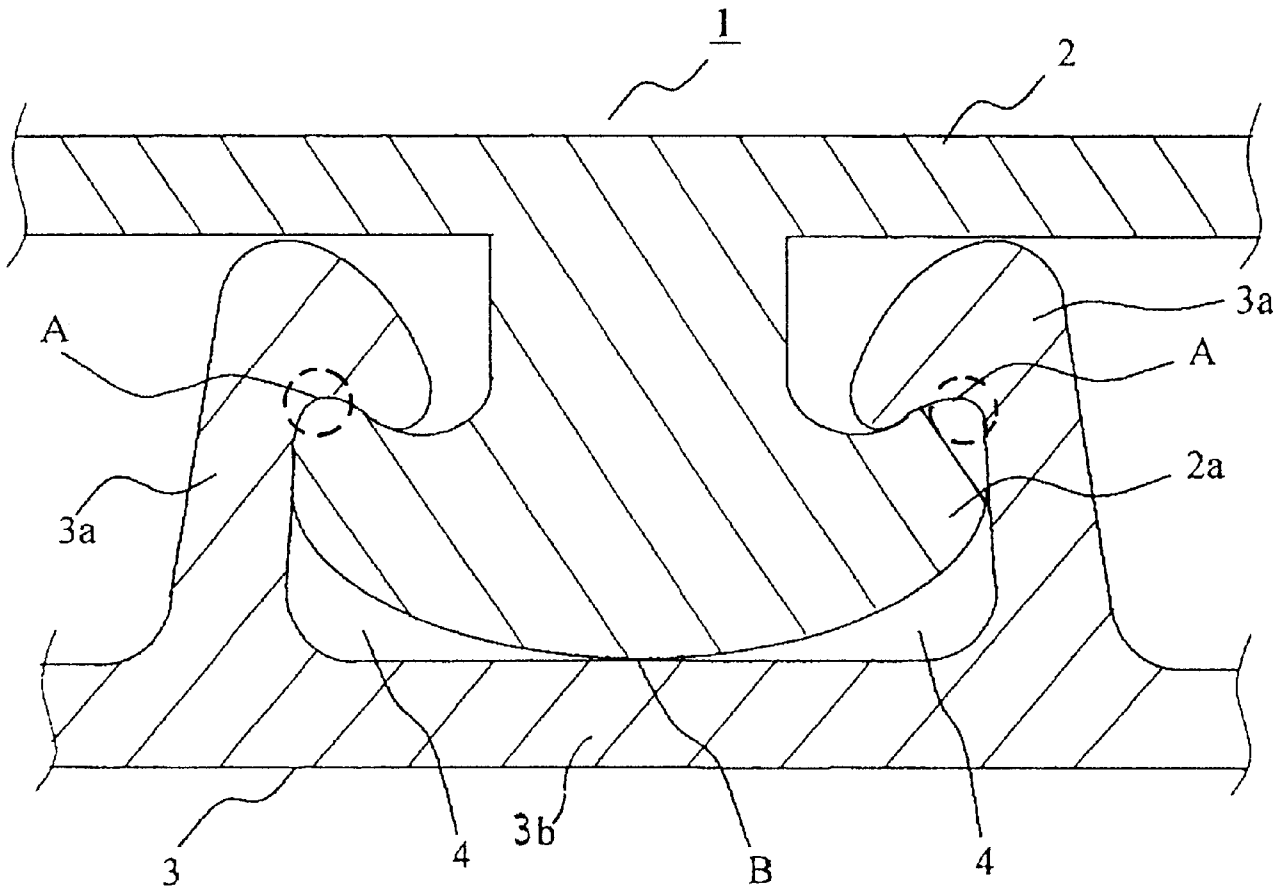
FIG. 1 is a cross-sectional view of a preferred embodiment of a chuck according to the present invention.

FIG. 1 is a cross-sectional view of a preferred embodiment of a chuck according to the present invention. This chuck 1 has a structure that the male claw portion 2*a* of a male member 2 contacts the female claw portions 3*a,* 3*a* of a female member 3 at positions A, A and contacts the base portion 3*b* of the female member 3 at a position B. The male claw portion 2*a* of the male member 2 is designed to contact and engage the female member 3 (including the female claw portions 3*a,* 3*a*) at a balanced position in the whole outer periphery thereof to maintain a fixed state. In addition, the male member 2 and the female member 3 are designed to have a bite while forming gaps 4, 4 therebetween so as to ensure smooth bite and release.

Figure 2:
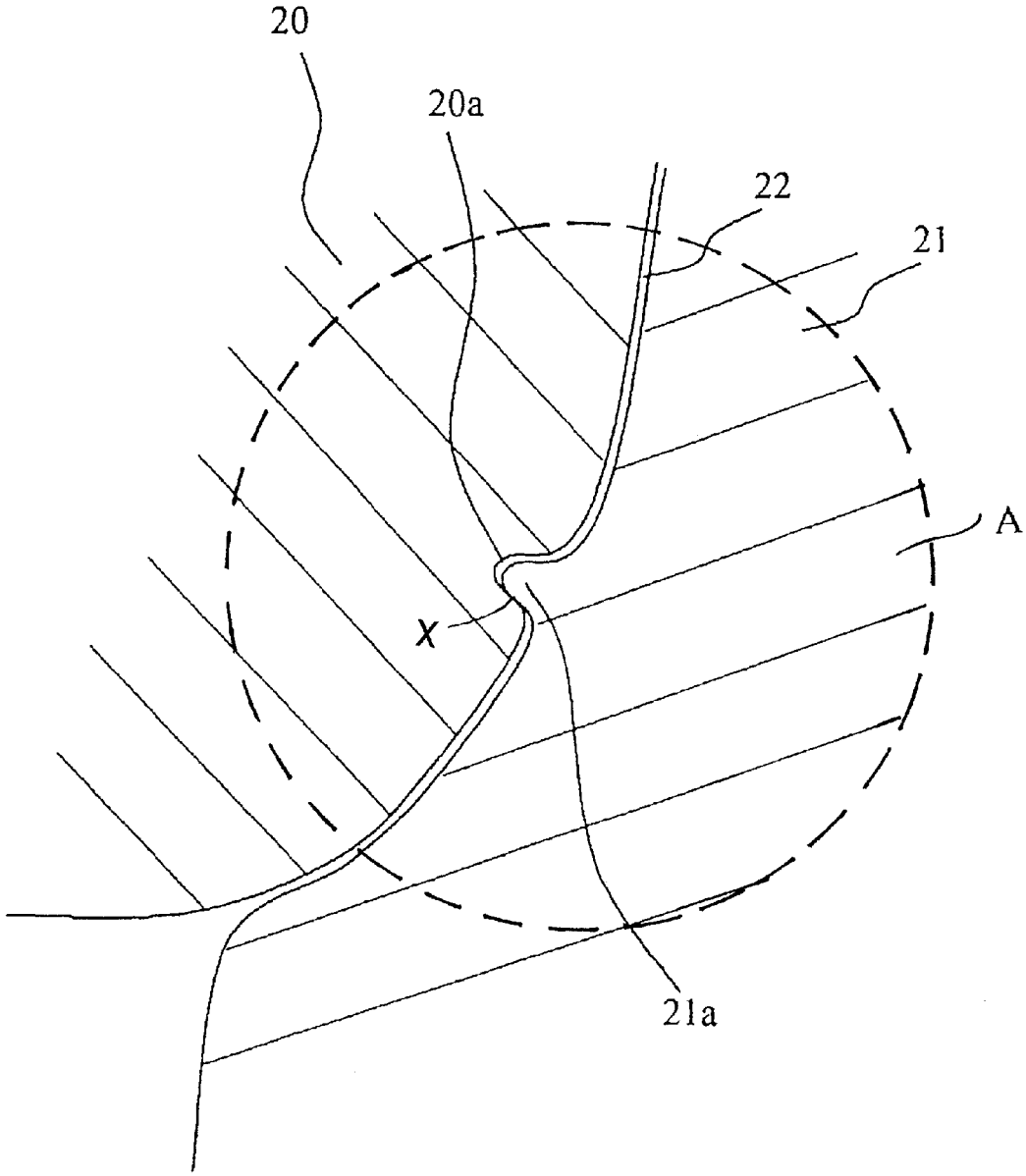
FIG. 2 is an enlarged cross-sectional view of a part of a preferred embodiment of a chuck according to the present invention.

FIG. 2 is an enlarged cross-sectional view of an example of a contact portion when a male claw portion and a female claw portion have a bite. In FIG. 2, a portion corresponding to A in FIG. 1 (i.e., a contact portion when the male claw portion and the female claw portion have a bite) is locally enlarged.

In a contact portion 22 shown in FIG. 2, when a male claw portion 20 contacts and engages a female claw portion 21, the male claw portion 20 contacts the protrusion 21*a* of the female claw portion 21 to be deformed due to its viscoelasticity to form a recessed portion 20*a* (which is also a bite portion or a fitted portion), so that the protrusion 21*a* and the recessed portion 20*a* have a tight bite.

The protrusion 21*a* linearly extends in the longitudinal direction of the female claw portion 21 over the whole width L (shown in FIG. 7), so that the protrusion 21*a* linearly contacts the recessed portion 20*a* in the longitudinal direction of the male and female claw portions 20 and 21 and forms a continuous linear contact. A surface contact X is provided in a strip-like region of the contact portion 22 which surrounds the protrusion 21*a* and has a predetermined width which extends in the longitudinal direction over the whole width L (shown in FIG. 7) wherein the male claw portion 20 contacts and engages the female claw portion 21. Therefore, the contact portion 22 has a contact structure, in which a line contact is arranged and the surface contact X is formed and continuously extends over the whole region of the claw portion in the longitudinal direction.

Although the contact portion 22 preferably has the contact structure in which the line contact is arranged in the surface contact X, other contact structures (e.g., a contact structure in which line and surface contacts X are continuously arranged) may be used to improve sealing performance. It has been revealed from experiments that sealing performance, such as gas blocking performance, can be given to the chuck if the contact portion 22 has a contact structure in which both of line contact and the surface contacts X exist (see Examples 1, 3, and 4 which will be described later).

In the contact portion 22 having the contact surface in which the line contact and the surface contacts X are continuously arranged, male and female members including male and female claw portions must be formed of a thermoplastic having physical properties (particularly mechanical properties) capable of giving sealing performance to the chuck.

Figure 3:
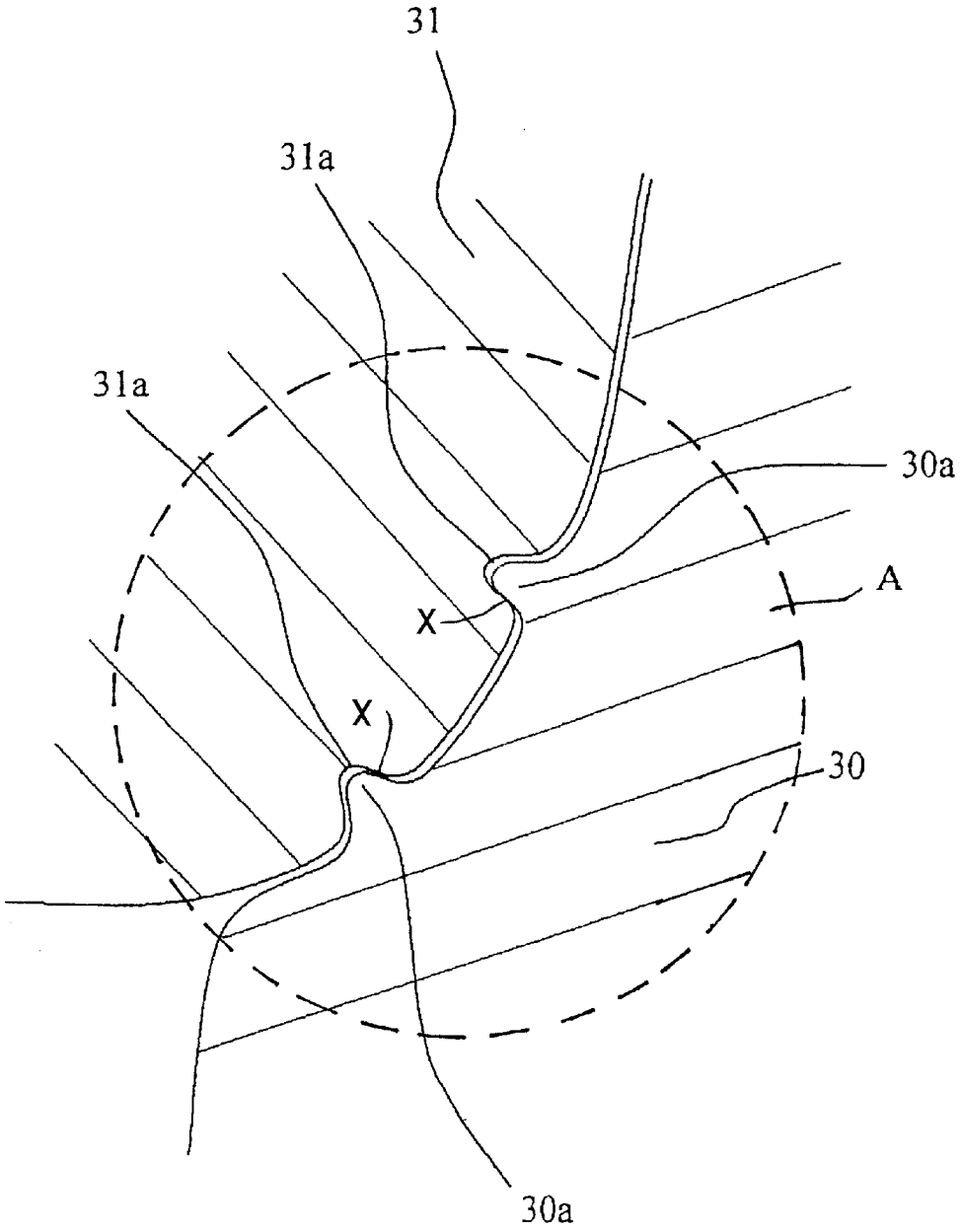
FIG. 3 is an enlarged cross-sectional view of a part of a preferred embodiment of a chuck according to the present invention.

FIG. 3 is an enlarged cross-sectional view of another example of a contact portion in which a male claw portion and a female claw portion have a bite. The contact portion shown in FIG. 3 has a structure in which a female claw portion 30 is provided with double protrusion linear portions 30*a*, 30*a* which linearly contact the recessed portions 31*a*, 31*a* of a corresponding male claw portion 31. The contact portion shown in FIG. 3 has a contact structure in which double line contacts are arranged in a surface contact X, X and continuously extend from the surface contact X, so that sealing performance, such as gas blocking performance, is improved. The number of the "protrusions" according to the present invention may be greater than two if it is possible to smoothly carry out he bite and release of male and female members.

Figure 4:
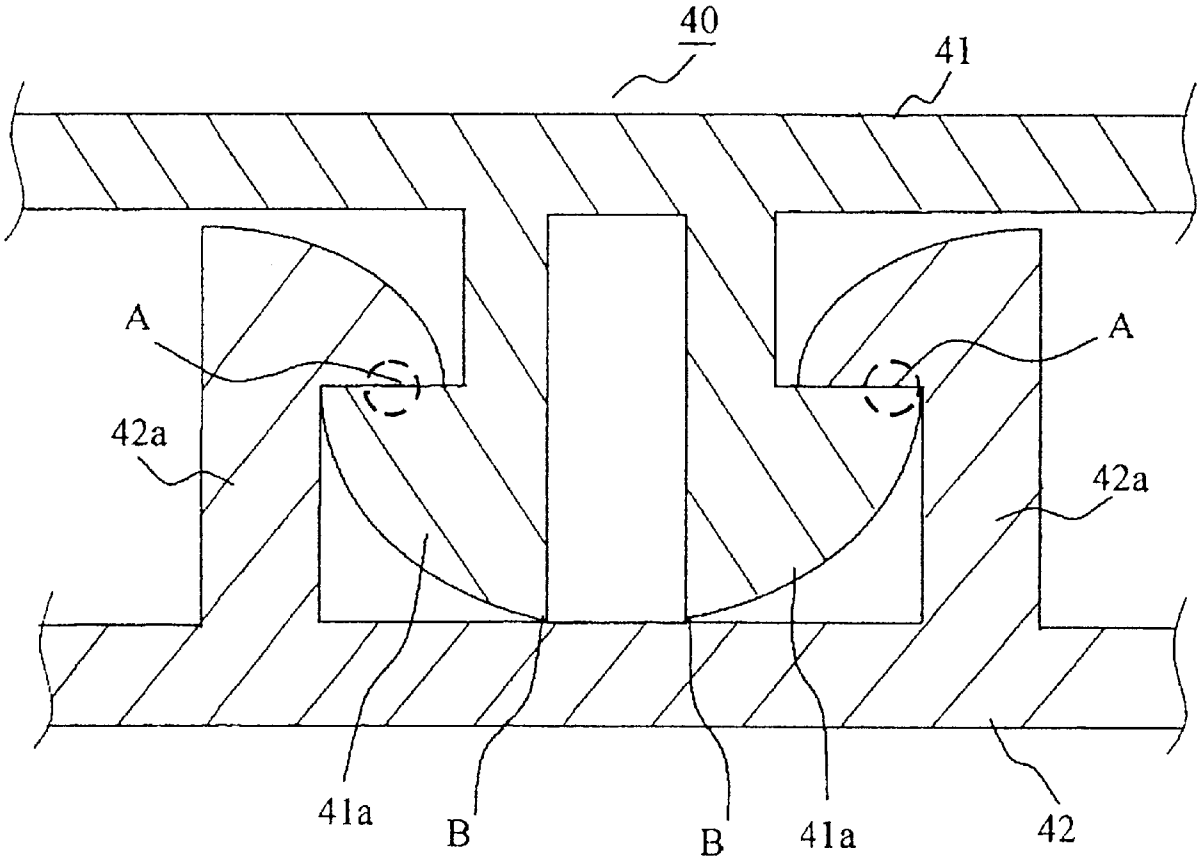
FIG. 4 is a cross-sectional view of a preferred embodiment of a chuck according to the present invention.

FIG. 4 is a cross-sectional view of another preferred embodiment of a chuck according to the present invention. The chuck 40 has a structure in which the male claw portions 41*a*, 41*a* of a male member 41 contact and engage the female claw portions 42*a*, 42*a* of a female member 42 at positions A, A and contact the base portion 42*b* of the female member 42 at positions B, B. The male claw portions 41*a*, 41*a* and the female claw portions 42*a*, 42*a* contact and engage each other at positions A, A in the same manner as FIG. 2 or 3 so that the chuck 40 has sealing performance including gas blocking performance. The male member 41 and the female member 42 can smoothly carry out bite and release, and sealing performance, such as gas blocking performance, can be maintained after the bite and release are repeated.

Figure 5:
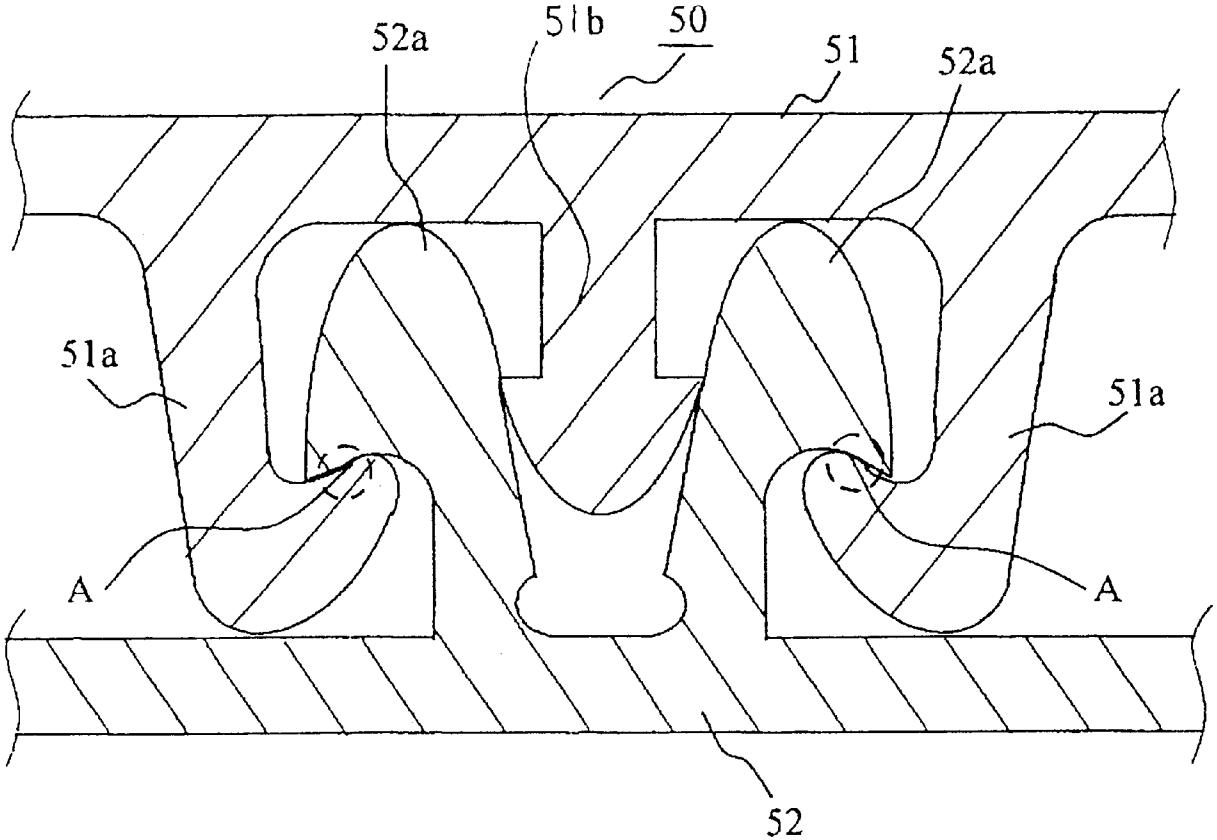
FIG. 5 is a cross-sectional view of a preferred embodiment of a chuck according to the present invention.

FIG. 5 is a cross-sectional view of another preferred embodiment of a chuck according to the present invention. The chuck 50 has a structure in which a male member 51 has double projecting male claw portions 51*a*, 51*a* and a projecting portion 51*b* provided therebetween and in which the male claw portions 51*a*, 51*a* contact and engage the female claw portions 52*a*, 52*a* of a female member 52 at positions A, A by the pressing force based on the projecting portion 51*b* in the same manner as FIG. 2 or 3.

Figure 12:
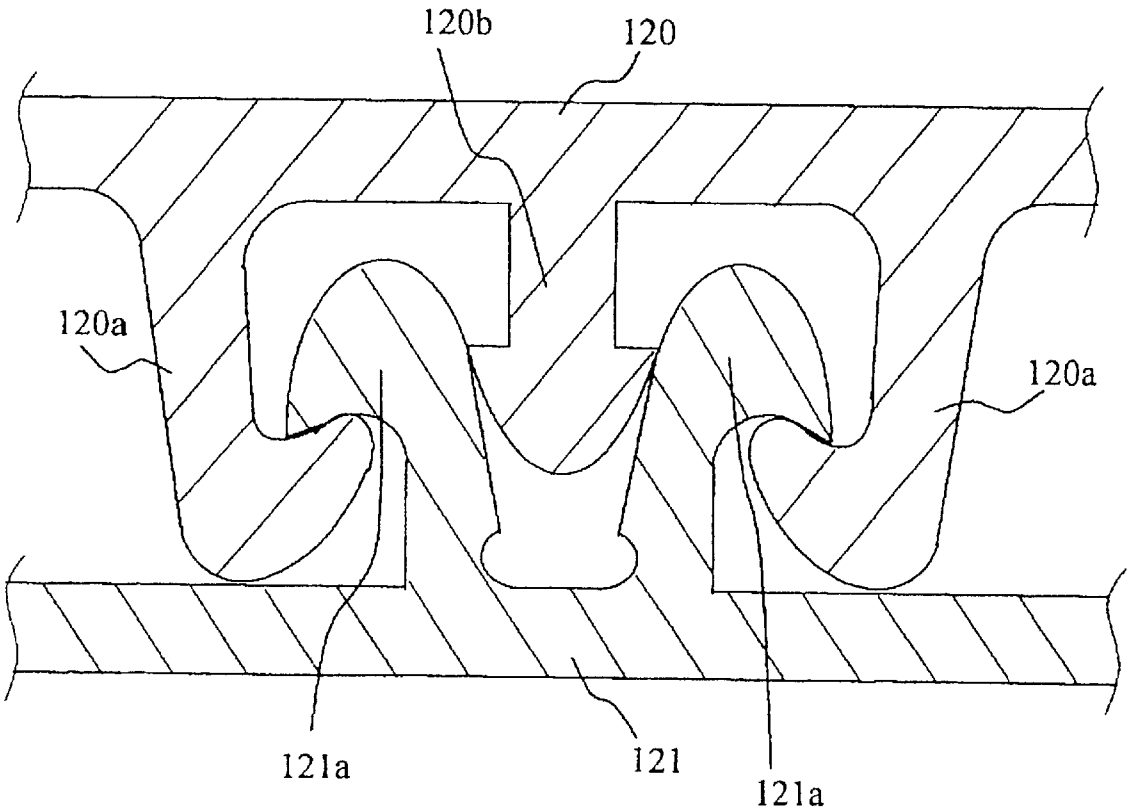
FIG. 12 PRIOR ART
FIG. 12 is a cross-sectional view of a still further conventional chuck.

The shape of the chuck 50 approximates the shape of the chuck shown in FIG. 12. However, in fact, the male claw portions 52*a*, 52*a* are pushed by the projecting portion 51*b* at a lighter pressing force to such an extent that the position is stable (i.e., a pressing force to such an extent that the chuck shown in FIG. 12 can not ensure liquid blocking performance). The chuck 50 can ensure sealing performance including gas blocking performance in the contact portion if such a light pressing force is applied.

Figure 6:
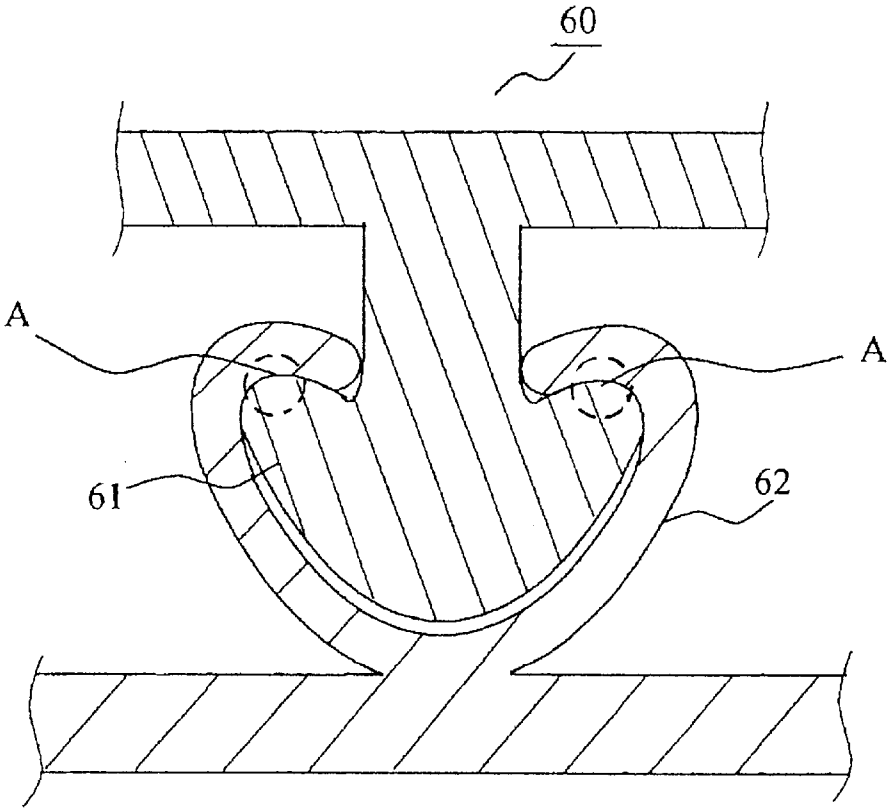
FIG. 6 is a cross-sectional view of a preferred embodiment of a chuck according to the present invention.

FIG. 6 is a cross-sectional view of another preferred embodiment of a chuck according the present invention. The chuck 60 has a structure in which a male claw portion 61 contacts female claw portions 62 at positions A, A to have a tight bite and in which the whole male claw portion 61 also contacts and engages the female claw portions 62. The chuck 60 has a structure that the male claw portion 61 contacts the female claw portions 62 as a whole to have a bite, so that the chuck 60 has gas blocking performance.

The "protrusion" according to the present invention is preferably provided on the female claw portion in order to provide high gas blocking performance and in order to ensure smooth opening and closing. However, if the male claw portion or both of the male and female claw portions have protrusions, the effects of the present invention can be obtained.

The shape and so forth (e.g., height, shape) of the "protrusion" according to the present invention can be determined on the basis of the gas blocking performance of the chuck and the smoothness of bite and release of the chuck due to the male and female claw portions. For example, the height of the protrusion may be about 0.3 to 25% of the width of the cross section of the claw portion. If the "protrusion" according to the present invention is provided in a place wherein force applied during bite is applied from the male claw portion(s) to the female claw portions, it is possible to improve sealing performance, such as gas blocking performance, of the chuck.

The male and female members of conventional chucks are molded articles of a thermoplastic having such thermal properties (typically, heat melting property, such as melt index) that male and female members can be fixed to a packaging bag base material film by the heat sealing. The materials of the molded articles include low density polyethylenes, straight chain low density polyethylenes, high density polyethylenes and polypropylenes.

The male and female members of the chuck according to the present invention are formed of a thermoplastic having both of mechanical properties and thermal properties capable of sealing performance during bite. For example, the mechanical properties include the relationship between stress and strain, rubber-like elasticity related to smoothness during bite and release and sealing performance during bite, and the strain recovery and stress relaxation related to sealing performance of the chuck when bite and release are repeated.

Therefore, the male and female members of the chuck according to the present invention are restricted by mechanical properties even if the members are formed of a low density polyethylene, a straight chain low density polyethylene, a high density polyethylene or a polypropylene, so that there are some cases where the present invention can not be used even if a thermoplastic capable of being the material of conventional male and female members is used. Therefore, in order to select the materials of the male and female members of the chuck, it is required to determine the materials by experiments.

In order to select the thermoplastic materials of the male and female members of the chuck according to the present invention, different kinds of suitable thermoplastic materials can be selected on the basis of mechanical properties, such as compressive strength (ASTMD 695), flexural strength (ASTMD 790), tensile elastic modulus (ASTMD 790) and torsional elastic modulus (ASTMD 1043). From the standpoint of mechanical properties, the male and female members can be formed of, e.g., a straight chain low density polyethylene.

The chuck according to the present invention can be attached on the opening portion of any one of various shaped packaging bags by the heat sealing or the like. For example, the chuck according to the present invention can be substituted for the conventional chuck 71 of the packaging bag 70 of FIG. 7. There is particularly no limit to the shape of the packaging bag, to which the chuck according to the present invention can be applied.

A packaging bag with a chuck according to the present invention comprises a packaging bag which is made of a base material film having gas barrier performance, and a chuck according to the present invention which is attached thereto. The base material films having gas barrier performance include a base material film which is formed of a material plastic having gas barrier performance, and a base material film which is formed of stacked plastic films so as to have gas barrier performance. For example, the base material films having gas barrier performance include stacked films of polyethylenes, ethylene-vinyl acetate copolymers, polypropylenes, polyvinyl chlorides, polyvinylidene chlorides, polyesters, nylons, vinylons, polystyrenes and other plastics. A metallic foil may be stacked on the stacked film. The chuck is provided on the base material film by a heat melting method (e.g., the heat sealing method, the impulse heat sealing method, the fusion sealing method, the ultrasonic sealing method or the high-frequency sealing method) or an adhesive method (e.g., the adhesive method, the pressure sensitive adhesive method or the heat sensitive adhesive method). In particular, the chuck according to the present invention can be fixed to a packaging bag by the heat sealing in the same producing line as a producing line in which the chuck has been produced.

Figure 7:
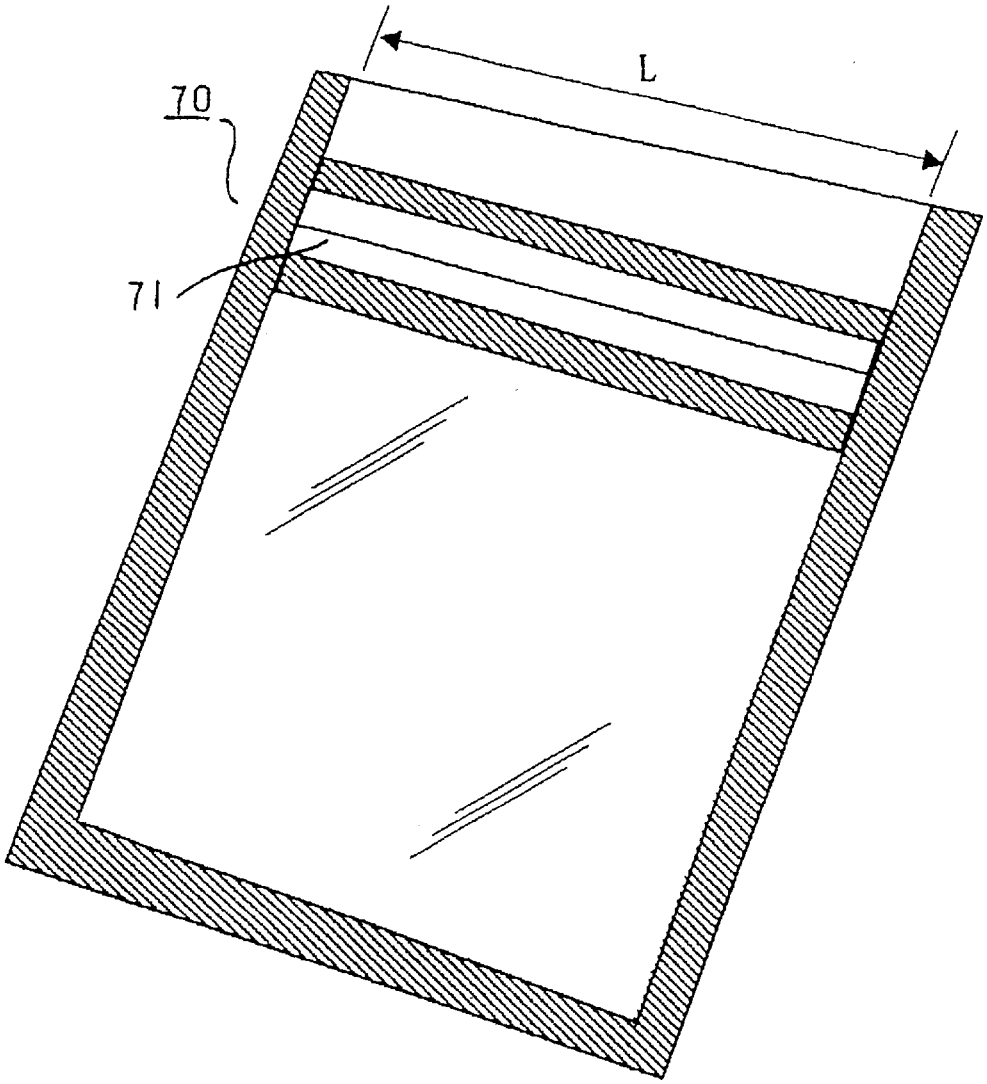
FIG. 7 PRIOR ART
FIG. 7 is an illustration of a conventional packaging bag with a chuck.
Figure 8:
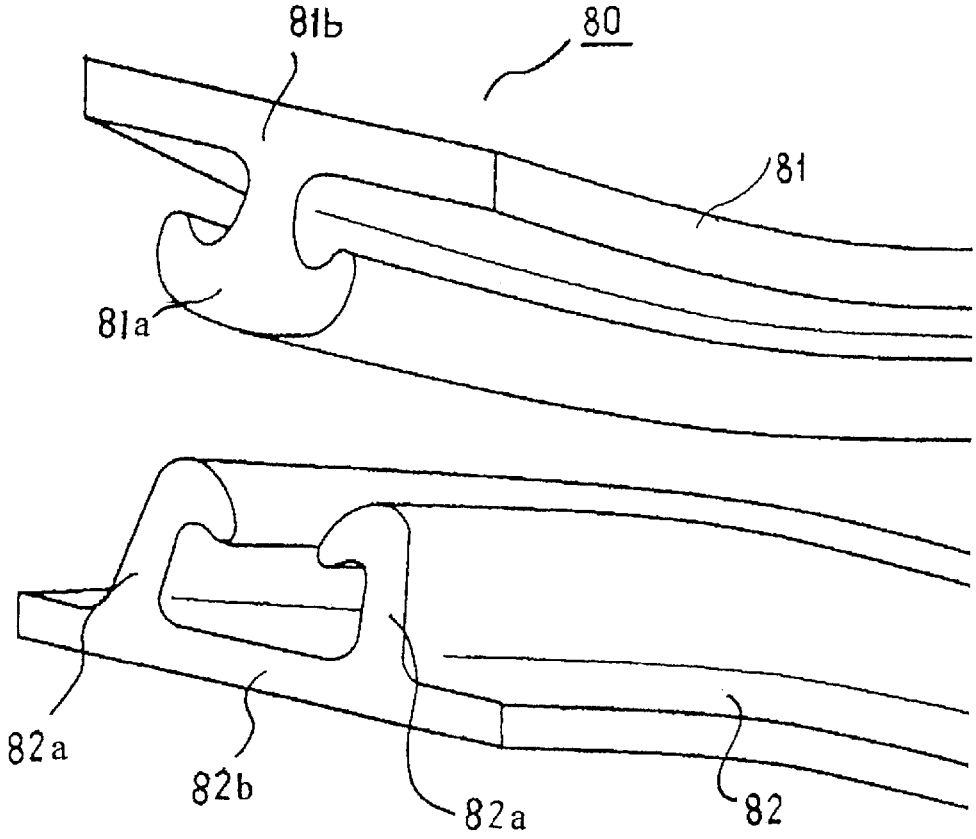
FIG. 8 PRIOR ART
FIG. 8 is a perspective view of a conventional chuck.
Figure 9:
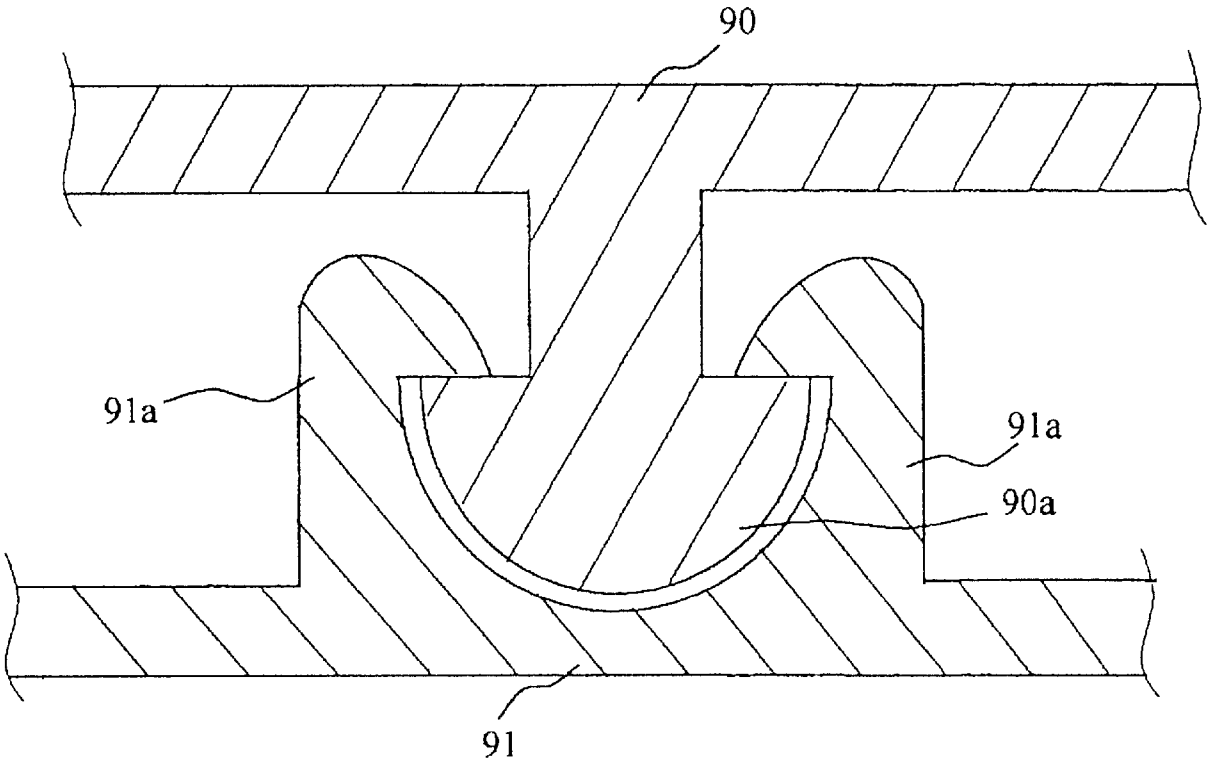
FIG. 9 PRIOR ART
FIG. 9 is a cross-sectional view of another conventional chuck.
Figure 10:
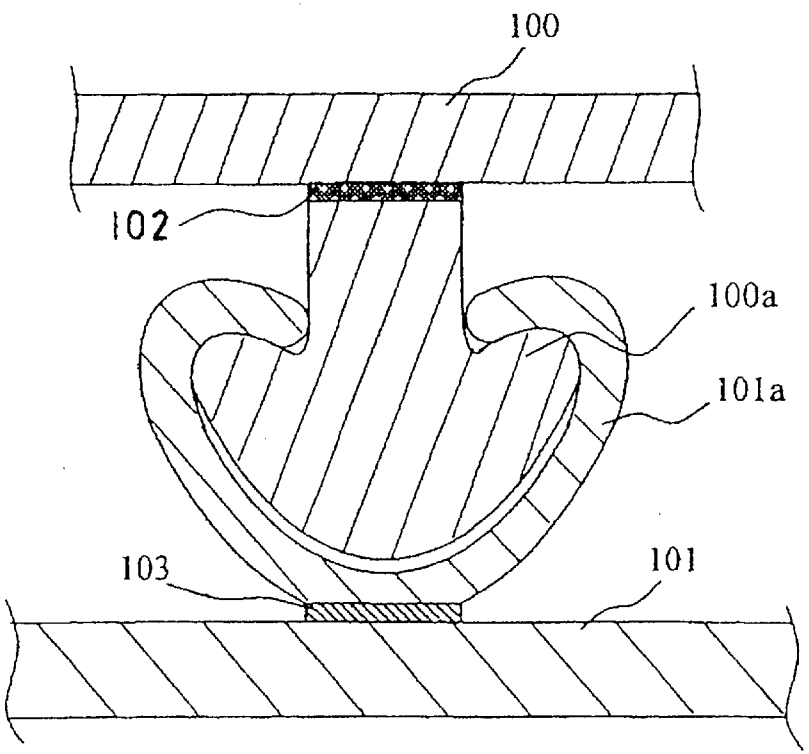
FIG. 10 PRIOR ART
FIG. 10 is a cross-sectional view of another conventional chuck.
Figure 11:
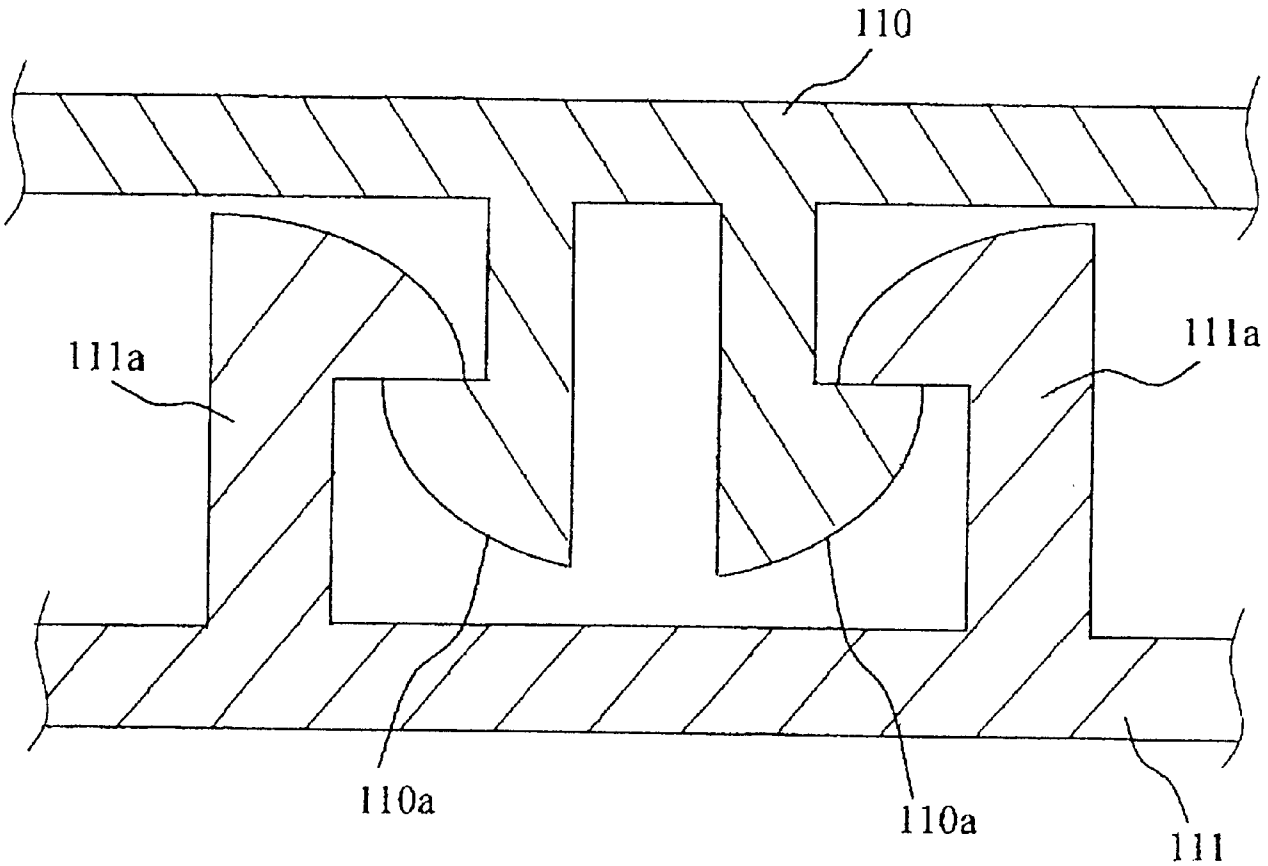
FIG. 11 PRIOR ART
FIG. 11 is a cross-sectional view of a further conventional chuck.

A packaging bag with a chuck according to the present invention has a chuck according to the present invention in place of, e.g., the conventional chuck 71 of FIG. 7. The interior of the packaging bag can be held in a substantial non-oxygen state by adding a deoxidation agent or the like, since the chuck has high gas blocking performance.

A packaging bag with a chuck according to the present invention has a high airtight housing region. Therefore, the packaging bag have many uses. In addition, the packaging bag can maintain the quality of goods to prevent the deterioration of the goods, and can be conveniently open and closed. For example, a packaging bag with a chuck according to the present invention can preserve foods while preventing the putrefaction and oxidation of the foods at high levels, can effectively preserve clothing in high level insect proof environment, and can preserve goods (e.g., foods, such as laver and tea leaves, and medicines), which are easily deteriorated by moisture, while maintaining the quality thereof.

A packaging bag with a chuck according to the present invention can house therein foods (e.g., liquid foods, such as mineral water, condiments, dressings, mayonnaise and soy sauce), which can not be housed in conventional packaging bags with a chuck.

In addition, a packaging bag with a chuck according to the present invention can effectively block smell, so that the packaging bag can effectively house and carry discomfort-smelling or special-smelling foods (e.g., Korean pickles, foods for farm animals and pets).

Moreover, a packaging bag with a chuck according to the present invention can be used for precision packaging for precision parts, electronics and so forth, due to sealing performance of the chuck, and can be used for the same purpose as that of airtight containers for various goods.

Furthermore, there is particularly no limit to the shape of a packaging bag with a chuck according to the present invention. A packaging bag with a chuck according to the present invention can be used as any one of all kinds of packaging bags, such as a two sided seal packaging bag, a three sided seal packaging bag, a shell sealing bag (a joined sealing bag, an envelope-like bag, a stand bag, a gusseted bag, etc.) and an inflation bag.

In order to facilitate better understanding of the present invention, examples of the present invention will be described below.

EXAMPLE 1

The same chucks as that shown in FIG. 1 or 2 were attached to three sided seal plastic packaging bags (outside dimension: 220 mm×315 mm) to prepare 10 packaging bags with chucks. The chucks were formed of a straight chain low density polyethylene by the profile extrusion molding method, and were fixed to the base material films of the packaging bags by the heat sealing. The base material films of the packaging bags were stacked films of nylon/straight chain low density polyethylene films. Furthermore, these packaging bags with chucks will be hereinafter referred to as test packaging bags A.

The test packaging bags were filled with nitrogen gas so as to have an oxygen concentration of 0.1%, and were left as they were at about 25° C. The oxygen concentrations in the test packaging bags were measured every the elapse of days by means of a zirconia oxygen analyzer to obtain the oxygen permeation amount of the test packaging bags A. The measured values of the oxygen permeation amounts of the test packaging bags are shown in Table 1.

TABLE 1

| Test Packaging Bag A Nos. | Oxygen Permeation Amount ml/bag · 24 hours |
|---|---|
| 1 | 2.21 |
| 2 | 0.67 |
| 3 | 1.90 |
| 4 | 2.67 |
| 5 | 2.33 |
| 6 | 0.89 |
| 7 | 0.60 |
| 8 | 2.33 |

TABLE 1-continued

| Test Packaging Bag A Nos. | Oxygen Permeation Amount ml/bag · 24 hours |
|---|---|
| 9 | 0.39 |
| 10 | 1.20 |

EXAMPLE 2

The chucks were cut from the test packaging bags A to prepare six packaging bags. These packaging bags were filled with nitrogen gas, and then, the openings thereof were heat-sealed. The oxygen permeation amounts of the heat-sealed packaging bags (which will be hereinafter referred to as comparative packaging bags) were measured in the same manner as Example 1. Table 2 shows the measured values of the oxygen permeation amounts of the comparative packaging bags.

TABLE 2

| Comparative Packaging Bag Nos. | Oxygen Permeation Amount ml/bag · 24 hours |
|---|---|
| 1 | 0.29 |
| 2 | 0.29 |
| 3 | 0.29 |
| 4 | 0.31 |
| 5 | 0.31 |
| 6 | 0.29 |

Comparing Table 1 with Table 2, the oxygen permeation amount of the test packaging bag A of number 7 in Table 1 (the test packaging bag having the smallest oxygen permeation amount) is 0.06 ml/bag·24 h, and the oxygen permeation amount of the comparative packaging bags of numbers 1, 2, 3 and 6 is 0.29 ml/bag·24 h, so that the difference therebetween, 0.31 ml/bag·24 h, is the amount of oxygen passing through the chuck. Therefore, from the results of experiments in Examples 1 and 2, it was revealed that the chucks having high sealing performance have high gas blocking performance and that the chucks having lower sealing performance also have high gas blocking performance for industrial use.

EXAMPLE 3

The same chucks as those in Example 1 were attached to three sided seal plastic packaging bags (outside dimension: 220 mm×275 mm) to prepare 16 packaging bags with chucks. The chucks were molded to be fixed to the base material films of the packaging bags by the same method as that in Example 1. The base material films of the packaging bags were stacked films of nylon/straight chain low density polyethylene films. Furthermore, these packaging bags with chucks will be hereinafter referred to as test packaging bags B. The oxygen concentrations in the test packaging bags B were measured by the same method as that in Example 1. Table 3 shows the measured values of the oxygen permeation amounts of the test packaging bags B. The results in Table 3 is substantially the same as those in Table 1.

TABLE 3

| Test Packaging Bag B Nos. | Oxygen Permeation Amount ml/bag · 24 hours |
|---|---|
| 1 | 1.11 |
| 2 | 0.76 |
| 3 | 0.83 |
| 4 | 1.11 |
| 5 | 0.71 |
| 6 | 1.24 |
| 7 | 1.29 |
| 8 | 0.97 |
| 9 | 0.70 |
| 10 | 1.59 |
| 11 | 0.72 |
| 12 | 0.86 |
| 13 | 0.77 |
| 14 | 0.88 |
| 15 | 0.85 |
| 16 | 0.84 |

EXAMPLE 4

The same chucks as those in Example 1 were attached to three sided seal plastic packaging bags (outside dimension: 220 mm×275 mm) to prepare 3 packaging bags with chucks. The base material films of the packaging bags were stacked films of transparent silica deposited polyester film/nylon film/straight chain low density polyethylene film. Furthermore, these packaging bags with chucks will be hereinafter referred to as test packaging bags C. The oxygen concentrations in the test packaging bags C were measured by the same method as that in Example 1. FIG. 3 shows the measured values of the oxygen permeation amounts of the test packaging bags C. The results in Table 3 also exhibit high gas blocking performance.

TABLE 4

| Test Packaging Bag C Nos. | Oxygen Permeation Amount ml/bag · 24 hours |
|---|---|
| 1 | 0.99 |
| 2 | 0.88 |
| 3 | 1.84 |

According to the present invention, it is possible to provide a chuck having sealing performance including gas blocking performance. That is, a packaging bag having a good housing region in a state (e.g., non-oxygen state) isolated from external environment can be open and closed by the chuck. It is also possible to provide a chuck which provide sealing performance including gas blocking performance by the bite of the chuck and which is capable of carrying out bite and release (i.e., the opening and closing of the chuck). It is also possible to close the chuck by various types of male and female claw portions to provide sealing performance including gas blocking performance. In addition, by utilizing easily recovered partial visco-elastic deformation during bite, it is possible to maintain sealing performance including gas blocking performance in the chuck after the chuck is repeatedly open and closed. Moreover, even if the contact pressure between the male and female claw portions is low, it is possible to provide sealing performance of the chuck to such an extent that gas blocking performance is provided, and it is possible to easily increase sealing performance by increasing the contact pressure.

According to the present invention, it is possible to provide a packaging bag with a chuck, which is capable of preserving and carrying goods in a state isolated from external environment, by using a gas impermeable film as the base material film of the packaging bag. A packaging bag with a chuck according to the present invention can be used for goods from which oxygen and other gases must be excluded (e.g., foods which rapidly become putrid, or electronic parts, the fraction defective of which increases in the presence of oxygen and other gases). If a packaging bag according to the present invention houses therein a deoxidation agent or another, it is possible to realize performance which has not been obtained by conventional packaging bags with chucks (e.g., non-oxygen state in a packaging bag when a deoxidation agent is housed therein). Moreover, a packaging bag with a chuck according to the present invention can be used for the same purpose as that of an airtight container.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A chuck for a plastic packaging bag, said chuck comprising:

a male member having a male claw portion;

a female member having a female claw portion; and a mechanism for causing said male claw portion to engage and disengage from said female claw portion;

a contact portion in which said male claw portion engages said female claw portion;

a line contact by which said male claw portion contacts said female claw portion in said contact portion, wherein one of said male claw portion and said female claw portion has at least one linear protrusion which extends in a longitudinal direction along said line contact and the other one of said male claw portion and said female claw portion has a complimentary recess for engaging each linear protrusion and providing a surface contact.

2. A chuck as set forth in claim 1, wherein said contact portion has a contact structure forming said surface contact on which said line contact is arranged in said surface contact and continuously extends from said surface contact.

3. A chuck as set forth in claim 2, wherein said one or more linear protrusions are provided on said female claw portion.

4. A chuck as set forth in claim 3, wherein said male member and said female member are formed of molded articles of a thermoplastic having mechanical properties which provide a contact structure forming said contact surface on which said line contact continuously extends from said surface contact.

5. A chuck as set forth in claim 2, wherein said male member and said female member are formed of molded articles of a thermoplastic having mechanical properties which provide a contact structure forming said contact surface on which said line contact continuously extends from said surface contact.

6. A chuck as set forth in claim 1, wherein said one or more linear protrusions are provided on said female claw portion.

7. A chuck as set forth in claim 6, wherein said male member and said female member are formed of molded articles of a thermoplastic having mechanical properties which provide a contact structure forming said contact surface on which said line contact continuously extends from said surface contact.

8. A chuck as set forth in claim 1, wherein said mail member and said female member are formed of molded articles of a thermoplastic having mechanical properties which provide a contact structure forming said surface contact on which said line contact continuously extends from said surface contact.

9. A plastic packaging bag with a chuck which comprises a male member having a male claw portion, a female member having a female claw portion, and a mechanism for causing said male claw portion to engage and disengage from said female claw portion;

a contact portion in which said male claw portion engages said female claw portion;

a line contact by which said male claw portion contacts said female claw portion in said contact portion, wherein one of said male claw portion and said female claw portion has at least one linear protrusion which extends in a longitudinal direction along said line contact and the other one of said male claw portion and said female claw portion has a complimentary recess for engaging each linear protrusion and providing a surface contact, and said plastic packaging bag being formed of a gas impermeable plastic film as a base material film.

* * * * *